United States Patent [19]

Livak

[11] Patent Number: 4,525,325

[45] Date of Patent: Jun. 25, 1985

[54] COPPER-NICKEL-TIN-COBALT SPINODAL ALLOY

[75] Inventor: Ronald J. Livak, Wallingford, Conn.

[73] Assignee: Pfizer Inc., New York, N.Y.

[21] Appl. No.: 634,516

[22] Filed: Jul. 26, 1984

[51] Int. Cl.[3] ..... C22C 9/02

[52] U.S. Cl. ..... 420/473; 148/11.5 C; 148/12.7 C; 148/11.5 P; 419/28

[58] Field of Search ..... 420/473, 496; 148/412, 148/433, 11.5 C, 12.7 C, 160; 419/28

[56] References Cited

U.S. PATENT DOCUMENTS 4,130,421 12/1978 Plewes et al. ..... 420/473

4,373,970 2/1983 Scorey et al. ..... 148/11.5 C

FOREIGN PATENT DOCUMENTS 5942 1/1981 Japan ..... 420/473

*Primary Examiner*—Peter K. Skiff

*Attorney, Agent, or Firm*—Charles J. Knuth; Peter C. Richardson; Lawrence C. Akers

[57] ABSTRACT

The ductility and electrical conductivity of an age hardened spinodally decomposed copper-nickel-tin alloy can be improved, without detracting from the alloy's strength properties, by reducing the nickel content of the alloy and adding from about 3.5 to about 7 weight percent, based upon the weight of the alloy, of cobalt.

35 Claims, No Drawings

COPPER-NICKEL-TIN-COBALT SPINODAL ALLOY

BACKGROUND OF THE INVENTION

The present invention relates to copper-base spinodal alloys and, in particular, copper-base spinodal alloys also containing nickel and tin.

Ternary copper-nickel-tin spinodal alloys are known in the metallurgical arts. As one example, U.S. Pat. No. 4,373,970 discloses spinodal alloys containing from about 5 to 35 weight percent nickel, from about 7 to 13 weight percent tin, and the balance copper. The alloys disclosed by this prior art patent exhibit in the age hardened spinodally decomposed state a highly desirable combination of mechanical and electrical properties, i.e. good strength and good electrical conductivity, and thus have valuable utility as a material of construction for articles of manufacture such as electrical connectors and relay elements. One particular ternary spinodal alloy composition falling within the scope of the disclosure of U.S. Pat. No. 4,373,970 contains about 15 weight percent nickel and about 8 weight percent tin and is sold commercially under the trade name of Pfinodal (Pfizer Inc.; New York, N.Y.). This alloy composition combines a sufficient strength for many commercial applications with a good ductility and an excellent electrical conductivity. When greater strength properties than those afforded by the Cu-15Ni-8Sn alloy composition are required for certain other applications, this can be realized by raising the nickel and tin levels within the ranges for those elements disclosed in U.S. Pat. No. 4,373,970. However, this increased strength tends to be achieved at the expense of the valuable ductility, formability and electrical conductivity properties of the age hardened spinodally decomposed alloy.

Other copper base spinodal alloys containing nickel and tin are disclosed in U.S. Pat. Nos. 3,937,638; 4,012,240; 4,090,890; 4,130,421; 4,142,918; 4,260,432 and 4,406,712. Of particular interest is U.S. Re. Pat. No. 31,180 (reissue of U.S. Pat. No. 4,052,204), which discloses the addition of small amounts of iron, zinc, manganese, zirconium, niobium, chromium, aluminum and magnesium to copper-nickel-tin spinodal alloys in order to improve mechanical and working properties. However this prior art patent does not disclose the use of cobalt as an additive element and does not suggest the use of a quaternary spinodal alloy system to obtain an improved electrical conductivity.

Quaternary copper-nickel-tin-cobalt alloys are disclosed in U.S. Pat. Nos. 3,940,290 and 3,953,249. These alloys contain only 1.5% to 3.3% tin and thus do not appear to be spinodal alloys. Furthermore, these prior art patents teach that the cobalt level in the alloy should not exceed 3% in order to minimize impairment of ductility and hot workability.

SUMMARY OF THE INVENTION

It has now been discovered that the replacement of a portion of the weight percentage of nickel in a copper-nickel-tin spinodal alloy with an approximately equal weight percentage of cobalt gives rise to improved ductility, formability (e.g. bendability) and electrical conductivity in the age hardened spinodally decomposed state without substantial diminishment of strength properties in that state. Thus, the present invention comprises a novel copper base spinodal alloy consisting essentially of from about 5 to about 30 percent by weight nickel, from about 4 to about 13 percent by weight tin, from about 3.5 to about 7 percent by weight cobalt and the balance copper, with the sum of the nickel and cobalt contents being no more than 35 percent by weight of the alloy.

Of particular interest is an alloy of the invention wherein the tin content is from about 8.5 percent by weight to about 13 percent by weight and the sum of the nickel and cobalt contents is at least 20 percent by weight. This alloy affords high strength properties while maintaining satisfactory ductility, formability and electrical conductivity properties for a wide variety of applications.

The present invention also comprises a powder metallurgical process for preparing the novel alloy of the invention.

As used herein the term "spinodal alloy" refers to an alloy whose chemical composition is such that it is capable of undergoing spinodal decomposition. An alloy that has already undergone spinodal decomposition is referred to as an "age hardened spinodally decomposed alloy", a "spinodal hardened alloy", or the like. Thus, the term "spinodal alloy" refers to alloy chemistry rather than alloy physical state and a "spinodal alloy" may or may not be at any particular time in an "age hardened spinodally decomposed" state.

The spinodal alloy of the present invention consists essentially of copper, nickel, tin and cobalt. The alloy may optionally contain small amounts of additional elements as desired, e.g. iron, magnesium, manganese, molybdenum, niobium, tantalum, vanadium, aluminum, chromium, silicon, zinc and zirconium, as long as the basic and novel characteristics of the alloy are not materially affected in an adverse manner thereby.

DETAILED DESCRIPTION OF THE INVENTION

The spinodal decomposition of the alloy of the present invention is an age hardening operation carried out for at least about 15 seconds at a temperature of from about 500° F. to about 1000° F. In any particular case the upper limit of this temperature range is primarily established by the chemical composition of the alloy while the lower limit of the range is primarily established by the nature and extent of working of the alloy performed immediately prior to the age hardening. Spinodal decomposition is characterized by the formation of a two-phase alloy microstructure in which the second phase is finely dispersed throughout the first phase. Optimum microstructures are obtained when the alloy is annealed and rapidly cooled before it is age hardened.

The spinodal alloy of the present invention may be prepared by a variety of known techniques involving, for example, casting from a melt (see e.g. U.S. Pat. No. 3,937,638) or sintering a body of compacted alloy powder (powder metallurgy). Because the use of casting processes tends to result in the presence of substantial tin segregation at grain boundaries in the spinodally decomposed product, the use of powder metallurgical techniques is preferred when the tin content is greater than about 6 percent by weight.

A particularly preferred powder metallurgical process for preparing an alloy of the present invention is the one set forth (for the Cu-Ni-Sn ternary system) in U.S. Pat. No. 4,373,970. Reference is made to that patent for a detailed description of this process, including guidelines for the proper selection of various operational parameters. It should be pointed out that this process may be readily adapted to prepare an alloy of the present invention in a wide variety of three-dimensional forms and not only in the form of a strip.

According to the process of U.S. Pat. No. 4,373,970, as adapted to prepare the quaternary alloy of the present invention, an alloy powder containing appropriate proportions of copper, nickel, tin and cobalt is compacted to form a green body having structural integrity and sufficient porosity to be penetrated by a reducing atmosphere, and preferably, a compacted density of from about 70 to 95 percent of the theoretical density, the green body is sintered, preferably for at least one minute at a temperature of from about 1400° F. to about 1900° F., more preferably from about 1600° F. to about 1700° F., and the sintered body is then cooled at a rate, typically at least about 200° F. per minute until the age hardening temperature range of the alloy has been traversed, such that age hardening and embrittlement are prevented. As used herein, the term "alloy powder" includes both blended elemental powders and prealloyed powders, as well as mixtures thereof.

Although the sintered body can be subjected directly to age hardening spinodal decomposition, it is preferred to first subject the alloy body to working (with cold working preferred to hot working) and annealing. Thus, prior to age hardening, the sintered body may be beneficially cold worked to approach the theoretical density and then annealed, preferably for at least about 15 seconds at a temperature of from about 1500° F. to about 1700° F., and rapidly quenched after annealing at a rate, typically at least about 100° F. per second, sufficient to retain substantially all alpha phase. If desired, the sintered alloy body may be cold worked in stages with intermediate anneal and rapid cooling between said stages. Also, the alloy body may be cold worked after the final anneal/cooling and immediately before age hardening in such a manner as to achieve a cross-sectional area reduction of at least about 5 percent, more preferably at least about 15 percent.

The duration of the age hardening spinodal decomposition operation should be carefully selected and controlled. The age hardening process proceeds in sequence through three time periods, i.e., the underaged time range, the peak strength aging time range and, finally, the overaged time range. The duration of these three phases will of course vary as the age hardening temperature is varied, but the same general pattern prevails. The strength properties of the age hardened spinodally decomposed alloy of the present invention are highest in the peak strength aging range and lower in the underaged and overaged ranges, while the ductility of the alloy tends to vary in the opposite manner (i.e. lowest in the peak strength aging range). On the other hand, the electrical conductivity of the alloy tends to continuously increase with the time of age hardening. The optimum age hardening time will depend upon the combination of electrical and mechanical properties sought for the alloy being prepared, but will usually be within the peak strength aging range and often, especially when a high electrical conductivity is of particular importance, within the latter half of that range.

For purposes of definition, the peak strength aging time for a particular alloy at a particular age hardening temperature is that precise time of age hardening at which the yield stress of the spinodal hardened alloy is at its maximum value.

The following examples illustrate the invention but are not to be construed as limiting the same.

EXAMPLES 1 TO 6

Elemental powders were blended in the proportions indicated in Table I for the six examples and then compacted into 3 in. by 0.5 in. by 0.125 in. rectangular bars at about 85 percent of theoretical density. Each bar was sintered in a dissociated ammonia atmosphere for about 60 minutes at 1625° F. and then about 30 minutes at 1750° F., cooled rapidly while still under the reducing atmosphere to prevent age hardening and embrittlement, cold rolled in at least four steps (with intermittent homogenization or anneal in the reducing atmosphere) to a 0.01 inch thickness, solution annealed for 5 minutes at 1650° F. in the reducing atmosphere and quenched rapidly in oil. Each bar was then age hardened in the ambient atmosphere at the time/temperature conditions set forth in Table I, with the age hardening time in each example corresponding approximately to the peak strength aging time at the indicated age hardening temperature, and then cooled to ambient temperature. The yield stress, ultimate tensile stress, percent elongation at break and electrical conductivity of the resulting six spinodally decomposed samples were measured and are also set forth in Table I.

The data of Table I clearly reveal that the replacement of a minor portion of nickel in a copper-nickel-tin age hardened spinodally decomposed alloy with an equal weight of cobalt provides a means of substantially increasing the ductility and electrical conductivity of the alloy without substantially altering the strength properties of the alloy.

TABLE I

| Example | Alloy Composition (percent by weight) Cu | Ni | Sn | Co | Age Hardening Condition Temp. (°F.) | Time (hrs.) | 0.2% Yield Stress (Ksi) | Ultimate Tensile Stress (Ksi) | Percent Elongation at Break (1 inch) gage length) | Electrical Conductivity (% IACS) |
|---|---|---|---|---|---|---|---|---|---|---|
| 1 | 61 | 30 | 9 | 0 | 850 | 3 | 146 | 147 | 0.5 | 3.6 |
| 2 | 61 | 24 | 9 | 6 | 850 | 3 | 149 | 152 | 2.2 | 4.4 |
| 3 | 67 | 24 | 9 | 0 | 850 | 3 | 136* | 142 | less than 0.2 | 4.6 |
| 4 | 67 | 20 | 9 | 4 | 850 | 1.5 | 142 | 146 | 3.0 | 4.8 |
| 5 | 74 | 18 | 8 | 0 | 800 | 3 | 119 | 122 | 1.4 | 5.9 |
| 6 | 74 | 14 | 8 | 4 | 800 | 3 | 121 | 124 | 1.8 | 7.0 |

*Yield strength at 0.05% offset; sample broke before reaching 0.2% offset.

I claim:

1. A copper base spinodal alloy consisting essentially of from about 5 to about 30 percent by weight nickel, from about 4 to about 13 percent by weight tin, from about 3.5 to about 7 percent by weight cobalt and the balance copper, with the sum of the nickel and cobalt contents being no more than 35 percent by weight of the alloy.

2. An alloy of claim 1 wherein the tin content thereof is at least about 8.5 percent by weight and the sum of the nickel and cobalt contents is at least 20 percent by weight of the alloy.

3. An alloy of claim 2 wherein the tin content thereof is from about 8.5 to about 11 percent by weight and the nickel content thereof is from about 20 to about 25 percent by weight thereof.

4. An age hardened spinodally decomposed alloy of claim 1.

5. An age hardened spinodally decomposed alloy of claim 2.

6. An age hardened spinodally decomposed alloy of claim, 3.

7. An alloy of claim 6, further characterized in that said alloy has an electrical conductivity of at least 4% IACS, a tensile yield stress (0.2% offset) of at least 140 ksi and a percent elongation (1 inch gage length) at its tensile break point of at least 2 percent.

8. An alloy of claim 4 that has been cold worked, in such a manner as to achieve a cross-sectional area reduction of at least about 5 percent, immediately prior to age hardening.

9. An alloy of claim 5 that has been cold worked, in such a manner as to achieve a cross-sectional area reduction of at least about 5 percent, immediately prior to age hardening.

10. An alloy of claim 6 that has been cold worked, in such a manner as to achieve a cross-sectional area reduction of at least about 5 percent, immediately prior to age hardening.

11. An alloy of claim 1 wherein the tin content thereof is from about 6 to about 8.5 percent by weight and the sum of the nickel and cobalt contents is no more than 20 percent by weight of the alloy.

12. An age hardened spinodally decomposed alloy of claim 11.

13. An alloy of claim 12 that has been cold worked, in such a manner as to achieve a cross-sectional area reduction of at least about 5 percent, immediately prior to age hardening.

14. An article of manufacture comprising the alloy of claim 1.

15. An alloy strip consisting essentially of the alloy of claim 1.

16. A process for preparing a copper base spinodal alloy body which comprises:

(a) providing a copper base alloy powder containing from about 5 to about 30 percent by weight nickel, from about 4 to about 13 percent by weight tin, from about 3.5 to about 7 percent by weight cobalt, and the balance copper, with the sum of the nickel and cobalt contents being no more than 35 percent by weight of the powder;

(b) compacting the alloy powder to form a green body having structural integrity and sufficient porosity to be penetrated by a reducing atmosphere;

(c) sintering the green body in the reducing atmosphere to form a metallurgical bond; and (d) cooling the sintered body at a rate such that age hardening and embrittlement are prevented.

17. A process of claim 16 wherein the alloy powder is compacted to at least about twice its original uncompacted density.

18. A process of claim 16 wherein the density of the green body is from about 70 to 95 percent of the theoretical density of said body.

19. A process of claim 16 wherein the sintering is at a temperature of from about 1400° F. to about 1900° F. for at least about one minute.

20. A process of claim 19 wherein the sintering is at a temperature of from about 1600° F. to about 1700° F.

21. A process of claim 16 wherein the sintered body is cooled below the age hardening temperature range of the alloy at a rate of at least about 200° F. per minute.

22. A process of claim 16 wherein the oxygen and carbon contents of the sintered body are each kept to less than about 100 ppm.

23. A process of claim 16 wherein said green body, said sintered body and said alloy body are each in the form of a strip.

24. A process of claim 16 comprising additionally:

(e) working the sintered body to a substantially fully dense condition; and (f) annealing the worked body and quenching it at a rate sufficient to retain substantially all alpha phase.

25. A process of claim 24 wherein the sintered body is cold worked in said step (e).

26. A process of claim 25 wherein said cold working results in a reduction of at least about 30 percent of cross-sectional area.

27. A process of claim 24 wherein the final anneal is at a temperature of from about 1500° F. to about 1700° F. for at least about 15 seconds, followed by quenching at a rate of at least about 100° F. per second to retain substantially all alpha phase.

28. A process of claim 24 wherein the alloy body is age hardened following the final anneal and quench.

29. A process of claim 28 wherein the age hardening is at a temperature of from about 500° F. to about 1000° F. for at least about 15 seconds.

30. A process of claim 29 wherein the duration of the age hardening treatment is approximately equal to the peak strength aging time of the alloy at the age hardening temperature.

31. A process of claim 28 wherein the alloy body is cold worked to achieve at least about a 5 percent reduction in cross-sectional area after the final anneal and quench but before the age hardening.

32. A process of claim 31 wherein the alloy body is cold worked to achieve at least about a 15 percent reduction in cross-sectional area after the final anneal and quench but before the age hardening.

33. A process of claim 24 wherein said green body, said sintered body, said alloy body and said worked body are each in the form of a strip.

34. A process of claim 28 wherein said green body, said sintered body, said worked body and said alloy body are each in the form of a strip.

35. A process of claim 24 wherein the annealed and quenched body is characterized by an equiaxed grain structure of substantially all alpha, face-centered-cubic phase with a substantially uniform dispersed concentration of tin and a substantial absence of tin segregation, and by a substantial absence of grain boundary precipitation.

* * * * *